US007175575B1

(12) United States Patent
Dantolen

(10) Patent No.: US 7,175,575 B1
(45) Date of Patent: Feb. 13, 2007

(54) RECIPROCATING WEIGHT EXERCISE APPARATUS

(76) Inventor: Harry E. Dantolen, 11045 S. Spaulding, Chicago, IL (US) 60655

( * ) Notice: Subject to any disclaimer, the term of this patent is extended or adjusted under 35 U.S.C. 154(b) by 186 days.

(21) Appl. No.: 10/826,096

(22) Filed: Apr. 16, 2004

(51) Int. Cl.
*A63B 21/05* (2006.01)
*A63B 21/02* (2006.01)
*A63B 21/06* (2006.01)

(52) U.S. Cl. ..... 482/128; 482/126; 482/121; 482/93

(58) Field of Classification Search ..... 482/93, 482/121, 106, 108, 109, 110, 98, 128, 126
See application file for complete search history.

(56) References Cited

U.S. PATENT DOCUMENTS 3,761,083 A * 9/1973 Buchner ..... 482/126
3,938,803 A * 2/1976 Wilmoth et al. ..... 482/132
4,775,149 A * 10/1988 Wilson ..... 482/126
5,312,308 A * 5/1994 Hamilton et al. ..... 482/44
5,328,431 A 7/1994 Winslow
5,334,118 A 8/1994 Dantolan
5,474,511 A * 12/1995 Dantolan ..... 482/93
5,536,227 A 7/1996 Polchek et al.
5,628,713 A 5/1997 Wilkinson
5,755,644 A * 5/1998 Breems ..... 482/67
5,788,608 A * 8/1998 Wilkinson ..... 482/51
5,839,996 A 11/1998 Goodling
5,876,312 A 3/1999 McClendon
6,228,002 B1 5/2001 Dantolan
6,379,286 B1 4/2002 Scopino et al.

* cited by examiner

*Primary Examiner*—Stephen R. Crow
*Assistant Examiner*—Allana Lewin
(74) *Attorney, Agent, or Firm*—Philip H. Kier

(57) ABSTRACT

A reciprocating exercise apparatus with a tube that has a slidable weight. The sliding action of the weight is damped by coil springs. To increase the types of exercises that can be performed with the apparatus there is a pair of stationary handles at the ends of the tube and a pair of handles that slide along the length of tube. The slidable handles are seated on sleeves with a swaged end. This configuration allows for exercises where the weight reciprocates alternately compressing one spring or the other and that can be performed with one hand or two. Auxiliary weights can be attached so a single unit is suitable for users with varying degrees of strength.

7 Claims, 3 Drawing Sheets

RECIPROCATING WEIGHT EXERCISE APPARATUS

BACKGROUND OF THE INVENTION

This invention is related to weight resistance exercise apparatus. More particularly, it is directed to improvements to an exercise apparatus having reciprocating weights.

The present invention improves the type of exercise apparatus disclosed by the inventor in U.S. Pat. Nos. 5,334,118 and 5,474,511. Those patents disclose exercise apparatus comprising a rigid rod with a sliding weight the movement of which is restrained along the length of the rod by coil springs at an end of the weight. The disclosed exercise apparatus embodiments have either a sliding handle or a stationary handle at the opposite end of each spring from the weight. Different muscle groups are exercised depending on how the apparatus is held and whether the handles are stationary or slidable.

The invention disclosed in those patents has some limitations. Exercises that call for one end of the apparatus being held against a vertical or horizontal surface while force is applied to a sliding handle are difficult to perform because the apparatus becomes unstable. Exercises that can be performed only with embodiments with sliding handles cannot be performed with embodiments with stationary handles, and visa versa. Also the difficulty in overcoming the resistance of the springs depends on the strength of the springs and the mass of the weight. A combination that is suitable for a strong person would be too difficult for a person with lessor strength. Conversely, a combination that is suitable for a person with lesser strength would be too easy for a strong person. These patents did not allow for changing the weights without a disassembly of the apparatus.

SUMMARY OF THE INVENTION

The invention is a reciprocating weight exercise apparatus comprising a rigid tube with a weight contained between two coil springs that can slide along the length of the rod. There is a slidable handle seated on a sleeve with a swaged end exterior to each spring that can compress the adjacent spring. A stationary handle covers each end of the tube. These tube ends are swaged to prevent a stationary handle from leaving the apparatus. Because the present invention has both stationary and slidable handles, exercises requiring either type of handle can be performed with one embodiment rather than two, as in the patents cited above. To protect a stationary handle from shock should a user suddenly let go of a slidable handle when the adjacent spring is compressed, there are shock absorbing means between a stationary handle and a slidable handle. Depending on the strength of the coil springs, the shock absorber means are a bushing and either an O-ring and or a spring. A user can hold one end of the tube against a surface by grasping the stationary handle at the other end of the tube with one hand while manipulating a slidable handle with the other hand. Thus the invention is a stable apparatus when performing exercises with one end of the rod held against a wall.

The weight may be threaded so that auxiliary weights can be attached to it. This variable weight capability gives the apparatus greater versatility without requiring partial disassembly to change weights. The additional mass of the auxiliary weights gives greater momentum to the weight when the apparatus is moved back and forth longitudinally. This greater momentum allows a user with lesser strength to do exercises with the same apparatus unit as a user with greater strength without need to changing the springs.

BRIEF DESCRIPTION OF THE SEVERAL VIEWS

DETAILED DESCRIPTION OF THE INVENTION

Figure 1:
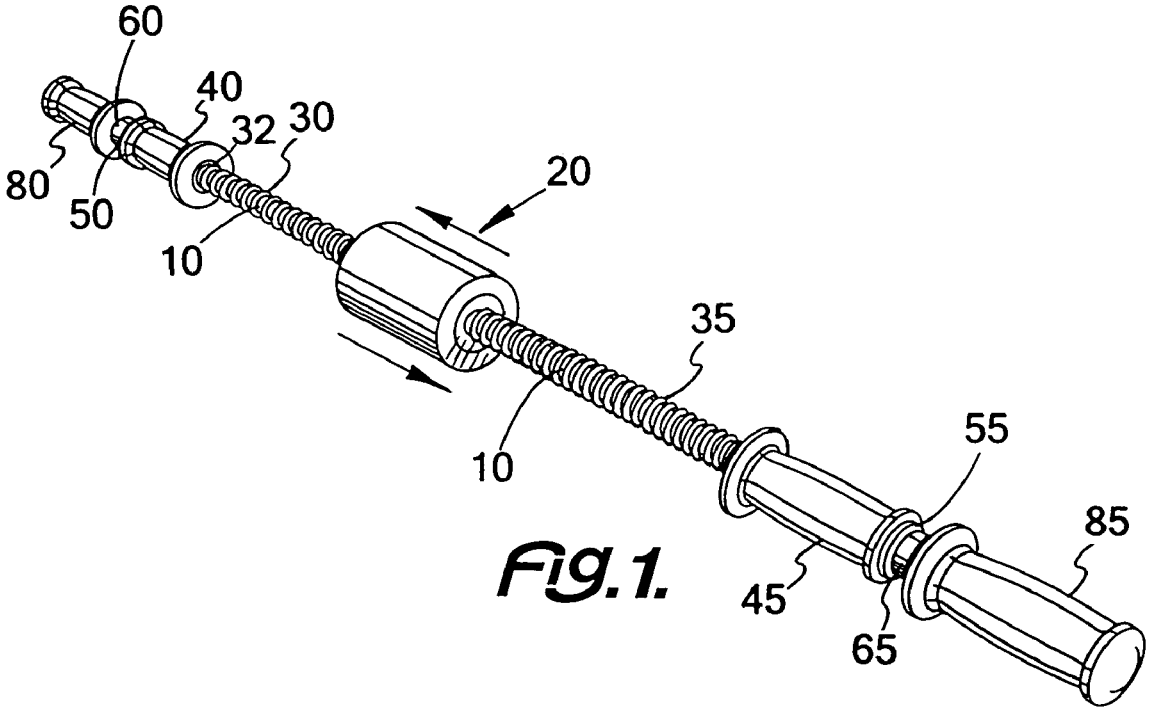
FIG. 1 is an illustration of a reciprocating weight exercise apparatus of the present invention.
Figure 2:
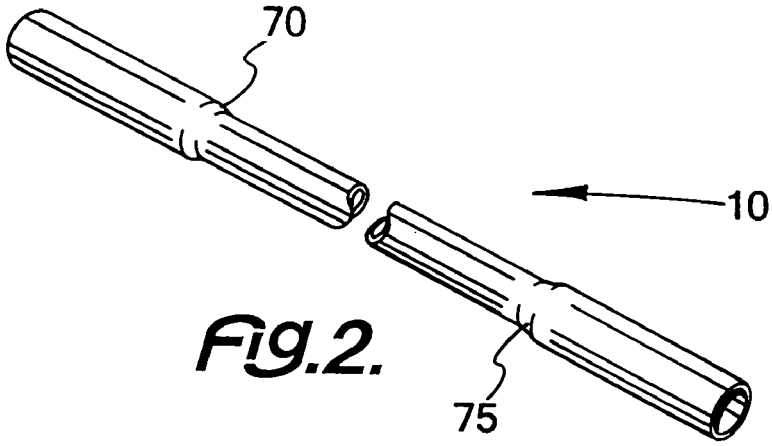
FIG. 2 is a view of a swaged end of the tube of a reciprocating weight exercise apparatus.

The embodiment illustrated in FIG. 1 has a rigid tube 10 with two ends. The tube can be made of steel, iron, aluminum, or such other material that can provide lightness and sufficient strength so that the tube is rigid when in use. The tube typically has an outer diameter of ¾ inch with an inner diameter of ⅝ inch, except near its ends where the outer diameter is expanded, or swaged, to an outer diameter of ⅞ inch as shown in FIG. 2. The inventor in U.S. Pat. No. 6,228,002 describes a method for swaging[1]. A permanent metal weight 20 slides on the tube. Typically, weights of one, two, three, or five pounds are used. There is a coil spring 30 and 35, respectively on each lateral side of the weight. The coil springs typically have a strength 20 pounds when fully compressed. There are slidable handles 40 and 45, respectively, outside of the coil springs. The handles can be made of rubber, vinyl, or another material that provides a good grip. Outward movement of a slidable handle is limited by an O-ring 50 and 55, respectively, a metal bushing 60 and 65, respectively, and swaged ends 70 and 75, respectively of tube 10. Affixed to the swaged ends of the tube are stationary handles 80 and 85, respectively. The O-rings help quiet use by preventing noisy metal-to-metal contact and provide some cushioning.

Figure 3:
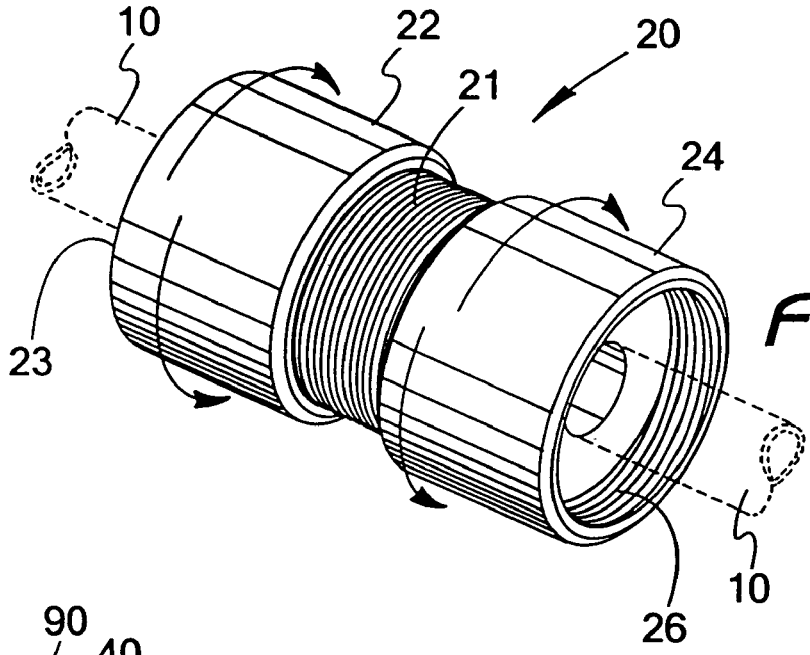
FIG. 3 shows the auxiliary weights threaded onto the permanent weight.

With reference to FIG. 3, weight 20 may have a threaded surface 21 onto which auxiliary weights 22 and 24 are attached. These auxiliary weights are annular with their inner surface 23 and 26, respectively, threaded and with an inner diameter greater than the outer diameter of other components of the apparatus. The auxiliary weights can then be moved inward toward the permanent weight and attached to the permanent weight without touching the other components of the apparatus. FIG. 3 shows threaded interior surface 26 of auxiliary weight 24. When the auxiliary weights are used, they should be threaded as far as possible on the permanent weight so that they are in contact with each other. This contact causes the auxiliary weights to lock together and prevents them from unthreading and falling off the permanent weight.

Figure 4:
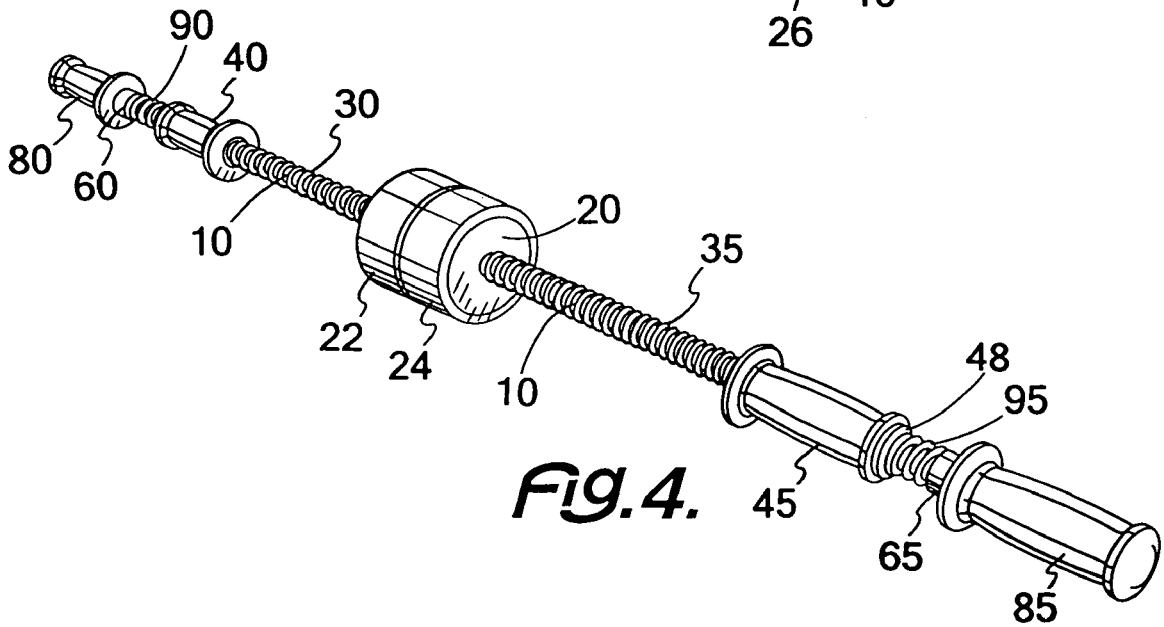
FIG. 4 shows an embodiment with springs as shock absorbing means.
Figure 5:
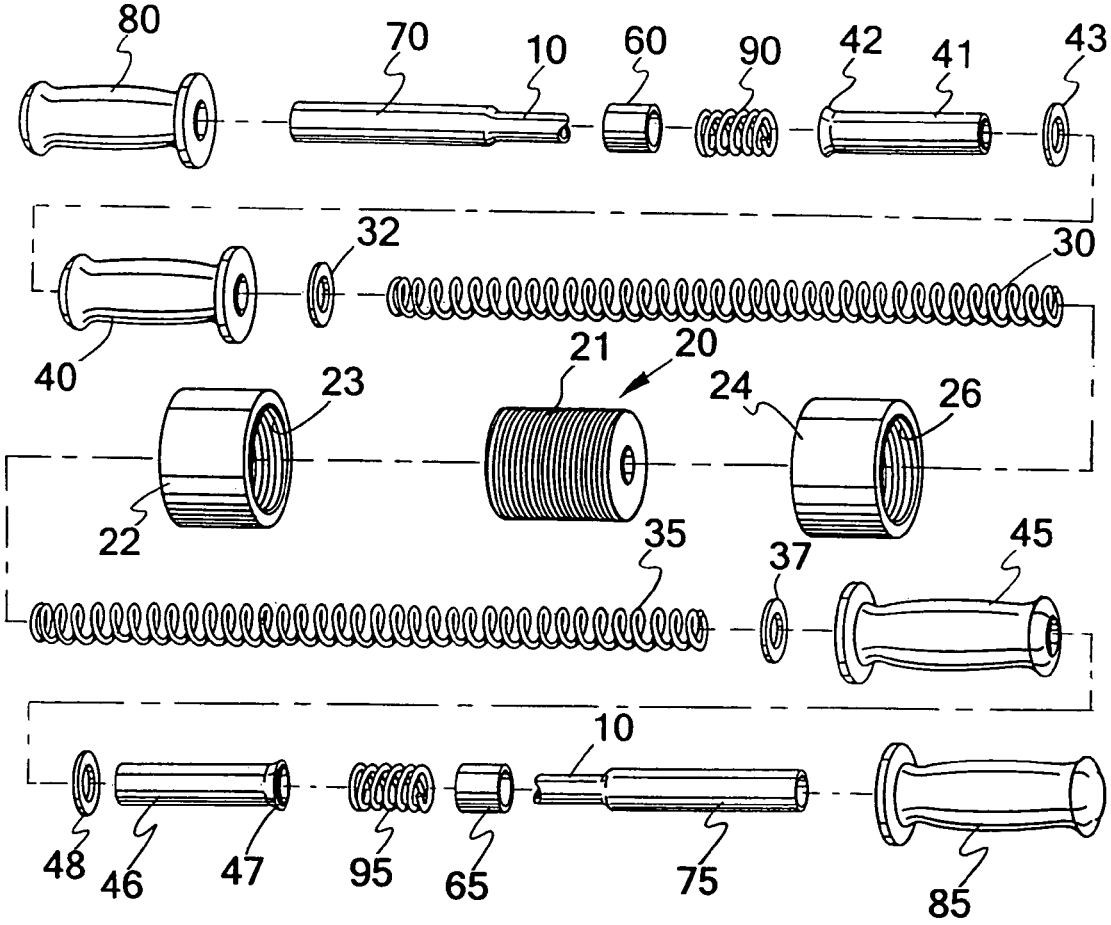
FIG. 5 is an exploded view of the apparatus.

For the apparatus to be challenging to a strong user, coil springs offering more than 20 pounds of resistance should be used. A stronger coil spring requires a more substantial shock absorbing system than is provided by an O-ring and a bushing. FIG. 4 shows an embodiment wherein the O-rings are replaced by shock absorbing springs 90 and 95, respectively. FIG. 4 also shows auxiliary weights 22 and 24 threaded onto permanent weight 20. The auxiliary weights can also be used in the embodiment shown in FIG. 1 that has O-rings. Each slidable handle fits on a sleeve 41 and 46, respectively, that has a swaged outer end 42 and 47. The sleeve allows a handle to slide on the tube. A washer 43 and 48, respectively, with an inner diameter less than the outer diameter of the sleeve where swaged keeps a slidable handle securely affixed to a sleeve. A second washer 32 and 37, respectively, is disposed between a coil spring and a slidable handle to prevent the coil spring and the slidable handle from coming in contact. The exploded view in FIG. 5 shows the sleeves and washers.

To use the device, a user grasps each handle and moves the tube back and forth in a direction parallel to its length. This motion causes the weight to slide back and forth along the length of the tube. The weight compresses the spring in the direction the weight is traveling causing a resistive force, which increases as the compression of the spring increases. Finally, the force exerted on the weight by the compressed spring together with the force exerted by the user is sufficient to stop the weight and reverse its direction. The same effect then takes place at the opposite side of the apparatus. The springs act to dampen the sliding motion of the weight to make the resistance or force felt by the user substantially uniform and substantially limiting the occurrence of any jarring or percussive forces. The amount of movement along the tube by the weight depends on the mass of the weight, spring strength, and the force exerted by the user. The greater the force exerted by the user and the mass of the weight, the greater the momentum imparted to the weight and the further it can travel before being slowed by the compressive force of the spring. The combination of the force exerted by the user to slide the weight and the resistance provided by the springs provides the physical conditioning benefits to the user. For a user who can exert only limited force to reap maximum benefit from exercise with the apparatus a heavier weight is needed than for a person who can exert more force. The outer surface of weight 20 can be threaded and auxiliary weights 22 and 24 threaded onto weight 20 to provide this heavier weight.

Many types of exercises can be performed with the present apparatus. The muscle groups exercised depend on the angle of inclination of the tube, the position of the tube relative to the body, the amount of weight used, the tension of the springs, and which handles the user grasps. The apparatus can be held horizontally at several heights, such as above the head, shoulder height, or waist height. It can be used in a vertical direction, or at any angle between vertical and horizontal when one end is held at a higher elevation than the other hand. The apparatus can also be used in a sitting or lying position.

Exercises can be performed with one end of the apparatus, say stationary handle 85, being placed against a hard vertical or horizontal surface. The user grasps the stationary handle at opposite end of the apparatus 80 with one hand to hold the apparatus in place while using the other hand to grasp either slidable handle and compress a spring. The user can also use both hands to grasp the slidable handles 40 and 45 and compress springs 30 and 35 simultaneously. The exercises that are described here are only a subset of the exercises that are possible with the present apparatus. Other exercises will become apparent to a user after use of the apparatus.

I claim:

1. A reciprocating weight exercise apparatus comprising:

a rigid tube having a first end and a second end;

a first stationary handle affixed to the first end and a second stationary handle affixed to the second end, the first end of the tube being swayed where the first stationary handle is affixed to it and the second end of the tube being swayed where the second stationary handle is attached to it;

a first coil spring and a second coil spring, the tube being deployed within the coil springs;

a permanent weight adapted for sliding along the length of the tube and between the first coil spring and the second coil spring, the permanent weight having sufficient weight to compress the coil springs;

a first slidable handle and a second slidable handle adapted for sliding along the length of the tube, the first slidable handle being adjacent to the first coil spring and the second slidable handle being adjacent to the second coil spring; and a first shock absorbing means deployed on the tube adjacent to the first stationary handle and a second shock absorbing means deployed on the tube adjacent to the second stationary handle;

wherein said first and second shock absorbing means are operatively associated with a respective first and second swaged end of the tube.

2. An exercise apparatus as set forth in claim 1 wherein each slidable handle is seated on a tubular sleeve with a swaged outer end.

3. An exercise apparatus as set forth in claim 2 wherein each shock absorbing means is an O-ring and a bushing.

4. An exercise apparatus as set forth in claim 2 wherein each shock absorbing means is a spring and a bushing.

5. A reciprocating weight exercise apparatus comprising:

a rigid tube having a first end and a second end;

a first stationary handle affixed to the first end and a second stationary handle affixed to the second end;

a first coil spring and a second coil spring, the tube being deployed within the coil springs;

a permanent weight adapted for sliding along the length of the tube and between the first coil spring and the second coil spring, the permanent weight having sufficient weight to compress the coil springs;

a first slidable handle and a second slidable handle adapted for sliding along the length of the tube, the first slidable handle being adjacent to the first coil spring and the second slidable handle being adjacent to the second coil spring;

a first shock absorbing means deployed on the tube adjacent to the first stationary handle and a second shock absorbing means deployed on the tube adjacent to the second stationary handle; and a first auxiliary weight attachable to one side of the permanent weight and a second auxiliary weight attachable to a side of the permanent weight opposite to the side to which the first auxiliary weight is attached, wherein the permanent weight has a threaded circular cylindrical surface and wherein each auxiliary weight is annular with a threaded interior surface such that the auxiliary weight can be screwed onto the permanent weight.

6. An exercise apparatus as set forth in claim 5 wherein each shock absorbing means is an O-ring and a bushing.

7. An exercise apparatus as set forth in claim 5 wherein each shock absorbing means is a spring and a bushing.

* * * * *